US007471247B2

(12) United States Patent
Säily et al.

(10) Patent No.: US 7,471,247 B2
(45) Date of Patent: Dec. 30, 2008

(54) ANTENNA ARRAY AND UNIT CELL USING AN ARTIFICIAL MAGNETIC LAYER

(75) Inventors: Jussi Säily, Espoo (FI); Mikko Kaunisto, Kirkkonummi (FI); Sergei Tretyakov, Espoo (FI); Constantin Simovski, St. Petersburg (RU)

(73) Assignee: Nokia Siemens Networks, Oy, Espoo (FI)

( * ) Notice: Subject to any disclaimer, the term of this patent is extended or adjusted under 35 U.S.C. 154(b) by 394 days.

(21) Appl. No.: 11/452,752

(22) Filed: Jun. 13, 2006

(65) Prior Publication Data

US 2007/0285316 A1 Dec. 13, 2007

(51) Int. Cl.
*H01Q 1/38* (2006.01)
*H01Q 15/02* (2006.01)

(52) U.S. Cl. ..... 343/700 MS; 343/909

(58) Field of Classification Search ..... 343/700 MS, 343/909, 770, 767, 842, 911
See application file for complete search history.

(56) References Cited

U.S. PATENT DOCUMENTS

| | | | | |
|---|---|---|---|---|
| 6,512,494 | B1 * | 1/2003 | Diaz et al. | 343/909 |
| 6,670,932 | B1 | 12/2003 | Diaz et al. | 343/909 |
| 6,774,867 | B2 * | 8/2004 | Diaz et al. | 343/909 |
| 6,954,177 | B2 * | 10/2005 | Channabasappa et al. | 343/700 MS |
| 7,042,419 | B2 * | 5/2006 | Werner et al. | 343/909 |
| 7,071,889 | B2 * | 7/2006 | McKinzie et al. | 343/756 |
| 7,330,161 | B2 * | 2/2008 | Matsugatani et al. | 343/909 |
| 2004/0008149 | A1 | 1/2004 | Killen et al. | 343/795 |
| 2007/0285318 | A1 * | 12/2007 | Sotoudeh et al. | 343/702 |

OTHER PUBLICATIONS

"Antenna Theory Analysis And Design", C.A. Balanis, John Wiley and Sons, Inc., 2d ed., 1997, pp. 432-436.

"High Performance C-Band Microstrip Patch Subarray With Dual Polarization Capabilities", F. Rostan et al., PIERS '94 pp. 1-4.

"Design Of Dual-Polarized L-Probe Patch Antenna Arrays With High Isolation", H. Wong, et al., IEEE Trans. Ant. Propag., vol. 52, No. 1, Jan. 2004, pp. 45-52.

"Minimising Mutual Coupling In Thick Substrate Microstrip Antenna Arrays", L.D. Bamford, et al., Electronics Letters, vol. 33, No. 8, Apr. 10, 1997, pp. 648-650.

"Dual-Polarized Array for Signal-Processing Applications in Wireless Communications", Bjorn Lindmark et al., IEEE, vol. 46, No. 6, Jun. 1998, pp. 758-763.

(Continued)

*Primary Examiner*—Huedung Mancuso
(74) *Attorney, Agent, or Firm*—Harrington & Smith, PC

(57) ABSTRACT

An antenna array includes a plurality of antenna unit cells, a ground plane, and at least one artificial magnetic layer AML unit cell. At least one AML unit cell is disposed between at least two adjacent ones of the antenna unit cells. The AML unit cells include a pair of split ring resonators through a ring dielectric layer, and the resonators are capacitively coupled to the a ground plane of the antenna array through a capacitor dielectric layer. The resonators are orthogonal to one another and to the ground plane, and more than one pair may be defined in each AML unit cell. Magnetic energy from the antenna unit cells induces an electric field in the resonators, and the resulting magnetic field is strongly coupled to the AML unit cell to inhibit mutual coupling between radiating elements by suppression of surface wave propagation.

19 Claims, 6 Drawing Sheets

OTHER PUBLICATIONS

"Dual-Polarized Slot-Coupled Printed Antennas Fed by Stripline", P. Brachat et al., IEEE, vol. 43, No. 7, Jul. 1995, pp. 738-742.
"Cavity-backed, Aperture Coupled Microstrip Patch Antenna", B.A. Brynjarsson et al., pp. 715-718.
"Design Of A Wideband Microstrip Array Antenna For PCS And IMT-2000 Service", Taewpp Lo, et al., Microwave And Optical Technology Letters, vol. 30, No. 4, Aug. 2001, pp. 261-265.
"Microstrip Antennas Integrated With Extromagnetic Band-Gap (EBG) Structures: A Low Mutual Coupling Design for Array Applications", Fan Yang et al., IEEE, vol. 51, No. 10, Oct. 2003.
"Design and radiation pattern measurements of the compact base station antenna array", Kalevi Laukkanen et al., VTT Information Technology Research Report TTE2-2003-18, Aug. 2003, 44 pages.
New compact and wide-band high-impedance surface, C.R. Simovaki et al., IEEE, 2004, pp. 297-300.
Martynyuk, Alexander E. et al., "Reflective Antenna Arrays Based on Shorted Ring Slots", IEEE MTTS-S Digest, 2001, pp. 1379-1382.
Biffi Gentili, G. et al., "Hybrid FE approach to evaluating edge effects in cavity-backed arrays", Electronics Letters, Apr. 10, 1997, vol. 33, No. 8, pp. 647-648, cited in the application.

* cited by examiner

ANTENNA ARRAY AND UNIT CELL USING AN ARTIFICIAL MAGNETIC LAYER

TECHNICAL FIELD

The present invention relates to antenna arrays, such as for example unit cell antennas disposed over a common substrate/ground plane such that energy propagation along that substrate/ground plane might cause the antennas to mutually couple in the transmit and/or receive modes absent design considerations. Such antenna arrays may be disposed in satellite or terrestrial network elements and handheld portable transceivers that communicate with those network elements.

BACKGROUND

Particularly in satellites and base transceiver stations of a terrestrial mobile communications network, but also increasingly in handheld portable devices themselves, multiple antenna radiator elements for communicating over different frequency bandwidths are used. These devices often communicate over disparate frequency bands simultaneously. To conserve space and weight, multiple antennas are sometimes deployed in an organized array of like antenna radiator elements.

Typically, base station antennas are re-configurable in order to adapt to different environments. Re-configurable antennas can save operators and manufacturers substantial amounts of money in smaller inventory requirements. Normally, a large set of antennas that have different beamwidths and gain values is required. A re-configurable antenna can be set either manually prior to mounting, or electrically while in the mast. Smart antennas or adaptive antennas have even more requirements, since they are required to generate complex radiation patterns that have maxima and minima in certain directions. These antennas use phased array techniques to synthesize the required beam.

That the radiating elements communicate simultaneously over different frequency bands raises the specter of mutual coupling between the antenna elements that can degrade the performance of each, which can become a serious problem in smart base station antennas using phased array techniques. Mutual interference among various antenna radiating elements degrades the array's directivity, can de-tune the elements, and creates blind spots (i.e., directions into which the main beam can not be steered). If the mutual coupling is not below a certain level, depending on the application, the array performance may be compromised.

It is well known that mutual coupling may be reduced by increasing physical spacing between the antenna radiating elements, resulting in increased antenna size for the array. See for example C. A. Balanis, "Antenna Theory: Analysis and Design" (John Wiley and Sons, Inc., 2d ed., 1997). Such increased separation between radiating elements also causes increased sidelobe levels in the radiation pattern. A normal separation of close to a half wavelength results in mutual coupling levels close to about −20 dB. Certain more advanced methods to reduce mutual coupling are listed below.

One approach to reduce mutual coupling among antenna elements is to select substrate materials so as to minimize surface waves. For example, a study done by F. Rostan, E. Heindrich, W. Wiesbeck, entitled "High-Performance C-band Microstrip Patch Subarray with Dual Polarization Capabilities", (PIERS '94, pp. 1-4), compares Duroid and Rohacell substrates at 5.3 GHz. The low permittivity ($\epsilon_r$=1.15) Rohacell substrate does not support surface waves and mutual coupling is close to −30 dB, the drawback being that antennas become large. With the higher permittivity ($\delta_r$=2.2) Duroid substrate the mutual coupling is at about a −23 dB level.

Another approach is to use interference effects to eliminate mutual coupling. H. Wong, K. L. Lau, K. M. Luk, "Design of dual-polarized L-probe patch antenna arrays with high isolation", *IEEE Trans. Ant. Propag.*, Vol. 52, No. 1, January 2004, pp. 45-52, and L. D. Bamford, J. R. James, A. F. Frey, "Minimising Mutual Coupling in Thick Substrate Microstrip Antenna Arrays", *Electronics Letters*, Vol. 33, No. 8, 10 Apr., 1997, pp. 648-650, indicate that this approach may be appropriate under some circumstances. The interfering components can be the surface wave in the substrate and the space wave in the air between the antennas. This technique is inherently narrowband, but mutual coupling levels of about −45 dB can be achieved.

Structural modifications of an antenna array can be applied to reduce mutual coupling. These include individual shielding of the antenna elements as in the paper by H. Wong et al. above, ground plane corrugations, using gridded patches for orthogonality, cavity backing of antenna elements, and the use of cuts in the substrate or in the groundplane. The expected mutual coupling levels by using these techniques are between about −25 to about −30 dB.

The use of photonic bandgap (PBG) materials in the ground plane may also be used to reduce mutual coupling. The use of PBG patches in a common ground plane of an antenna array has been reported at higher frequencies (e.g., 5.8 GHz), but the inventors are unaware of work showing that this technique would be operative for typical mobile telephony/cellular communication frequencies (e.g., 2 GHz and lower, especially the UMTS range 1.92-2.17 GHz and the GSM ranges 0.824-0.960 GHz and 1.710-1.990 GHz.). The problem has typically been that the commonly known PBG structures, like mushroom-PBG and uniplanar UC-PBG, are too large in size at low microwave frequencies.

SUMMARY

The foregoing and other problems are overcome, and other advantages are realized, in accordance with the presently described embodiments of these teachings.

In accordance with an exemplary embodiment of the invention, there is provided an antenna array that includes a plurality of antenna unit cells and at least one artificial magnetic layer (AML) unit cell. The antenna unit cells are disposed in an array and spaced from one another. Each antenna unit cell includes a radiating element and a ground plane element. The AML unit cell is disposed between at least two adjacent ones of the antenna unit cells. The AML unit cell includes at least one pair of split-ring resonators The AML unit cell is capacitively coupled to the ground plane elements of the adjacent antenna unit cells.

Further, in accordance with another exemplary embodiment of the invention, there is provided an apparatus that includes an array of unit cells disposed on a common substrate. Each unit cell includes a first layer of dielectric material having a first and an opposed second major surface, a second dielectric layer that is disposed adjacent to the first major surface, a pair of intersecting conductive traces disposed on the opposed major surface of the first layer of dielectric material, and at least four conductive vias that each penetrate the first but not the second layer of dielectric material. Each of the conductive vias are spaced from one another and coupled to a conductive trace.

In accordance with another embodiment is a method of making an antenna array. In this method, a substrate is provided that is particularly adapted to retain the antenna unit cells and the tile components described below in spaced relation to one another. A plurality of antenna unit cells is secured to the substrate, such that each antenna unit cell is spaced from each other antenna unit cell. Each antenna unit cell includes a ground plane element spaced from a radiating element. Between each pair of adjacent antenna unit cells, a tile is secured to the substrate. The tile includes an array of artificial magnetic layer AML unit cells. Each AML unit cell includes a ring dielectric layer having a first and a second surface, a capacitor dielectric layer coupled to the first surface, a pair of conductive traces disposed adjacent to the second surface, and a set of at least four conductive vias penetrating the ring dielectric layer but not the capacitor dielectric layer. Each of the conductive vias are spaced from one another and coupled to one of the conductive traces. The capacitor dielectric layer is then capacitively coupled to at least one of the ground plane elements of the antenna unit cells, such a by transmitting or receiving with one of the antenna unit cells to generate a surface wave in its ground plane element.

In accordance with another embodiment of the invention is an arrayed apparatus that includes a plurality of means for wirelessly communicating RF energy over a frequency, a plurality of means for inhibiting mutual coupling between the means for wirelessly communicating RF energy, and conductive means. The plurality of means for wirelessly communicating RF energy are arrayed in spaced relation to one another. Each of the means for inhibiting mutual coupling is disposed between adjacent ones of the plurality of means for wirelessly communicating RF energy, and each of the means for inhibiting mutual coupling includes at least one split ring resonator. The conductive means is for electrically coupling to one another each of the plurality of means for inhibiting mutual coupling. Further in the arrayed apparatus, the conductive means and each of the means for inhibiting mutual coupling are disposed in a common ground plane. In one embodiment, the means for wirelessly communicating RF energy over a frequency includes a radiating element of an antenna unit cell, and the means for inhibiting mutual coupling includes at least one AML unit cell.

Further details as to various embodiments and implementations are detailed below.

BRIEF DESCRIPTION OF THE DRAWINGS

The foregoing and other aspects of these teachings are made more evident in the following Detailed Description, when read in conjunction with the attached Drawing Figures, wherein.

DETAILED DESCRIPTION

What is needed in the art is an apparatus to arrange an array of antenna elements or antenna unit cells to control mutual coupling among the antenna unit cells at frequencies that include particularly cellular communications frequencies, for example the UMTS band of 1920 to 2170 MHz. Preferably, such a solution would enable a compact design that does not rely on physical spacing between the antenna unit cells to control mutual coupling.

Figure 1:
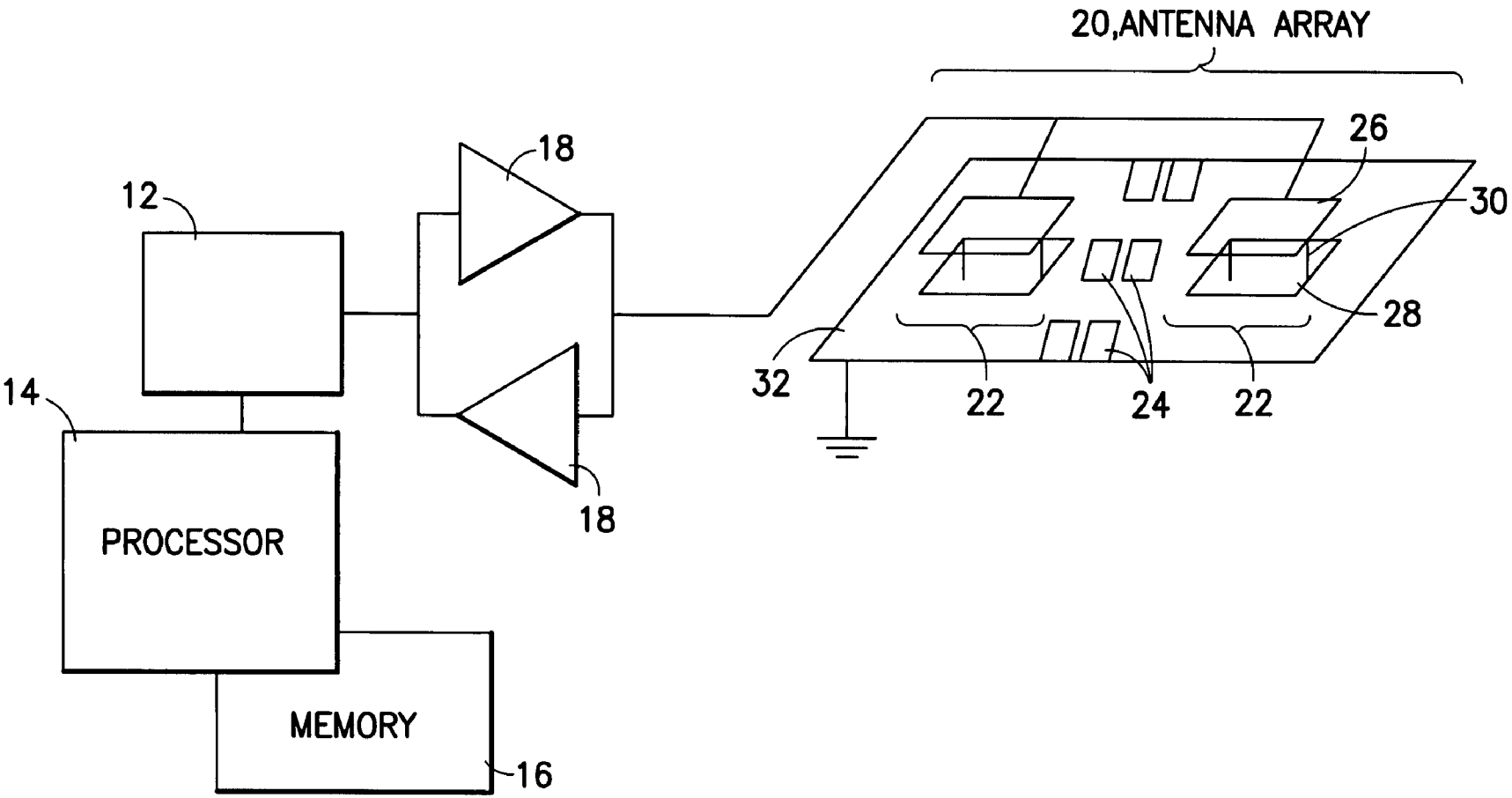
FIG. 1 is a schematic block diagram of a transceiver coupled to an antenna array.

FIG. 1 shows in schematic diagram from the relevant functional blocks of a device 10, such as a base transceiver station or a mobile station in which the described invention may be advantageously disposed. A transceiver 12 processes input and output signals as controlled by a processor 14 accessing a memory 16. Together, these components 12, 14, 16 encode and decode, apply spreading and despreading codes, encrypt/decrypt, multiplex/demultiplex, and modulate/demodulate those input and output signals. The memory or memories 16 may be of any type suitable to the local technical environment and may be implemented using any suitable data storage technology, such as semiconductor-based memory devices, magnetic memory devices and systems, optical memory devices and systems, fixed memory and removable memory. The data processor(s) 14 may be of any type suitable to the local technical environment, and may include one or more of general purpose computers, special purpose computers, microprocessors, digital signal processors (DSPs) and processors based on a multi-core processor architecture, as non-limiting examples.

Amplifiers 18 apply a gain to the uplink or downlink signal and may be coupled to a transmit/receive switch or a diplex filter to enable bi-directional signal propagation. Those signals are transmitted and received over an antenna array 20 that includes a plurality of antenna unit cells 22 (two shown) and at least one artificial magnetic layer AML unit cell 24 (six AML unit cells shown) between the antenna unit cells 22. Each antenna unit cell 22 includes a radiating element 26 and a ground plane element 28 spaced from one another by spacers 30, which may be vertically oriented stanchions as shown or a layer of insulating material at a defined and engineered thickness. Each radiating element 26 is coupled to the transceiver 12 so as to enable beamforming or selectivity of the various antenna unit cells 22 for transmissions and receptions on different frequencies. The AML unit cells 24 are co-planar with the ground plane elements 28 and electrically coupled to them, so as to functionally form a unitary ground plane 32 for the entire antenna array 20. As will be described, the AML unit cells 24 operate to disrupt mutual coupling between adjacent antenna unit cells 22 which is present in the known designs due to TE- (transverse electric field) and TM-mode (transverse magnetic field) surface wave propagation in the ground plane.

Figure 6:
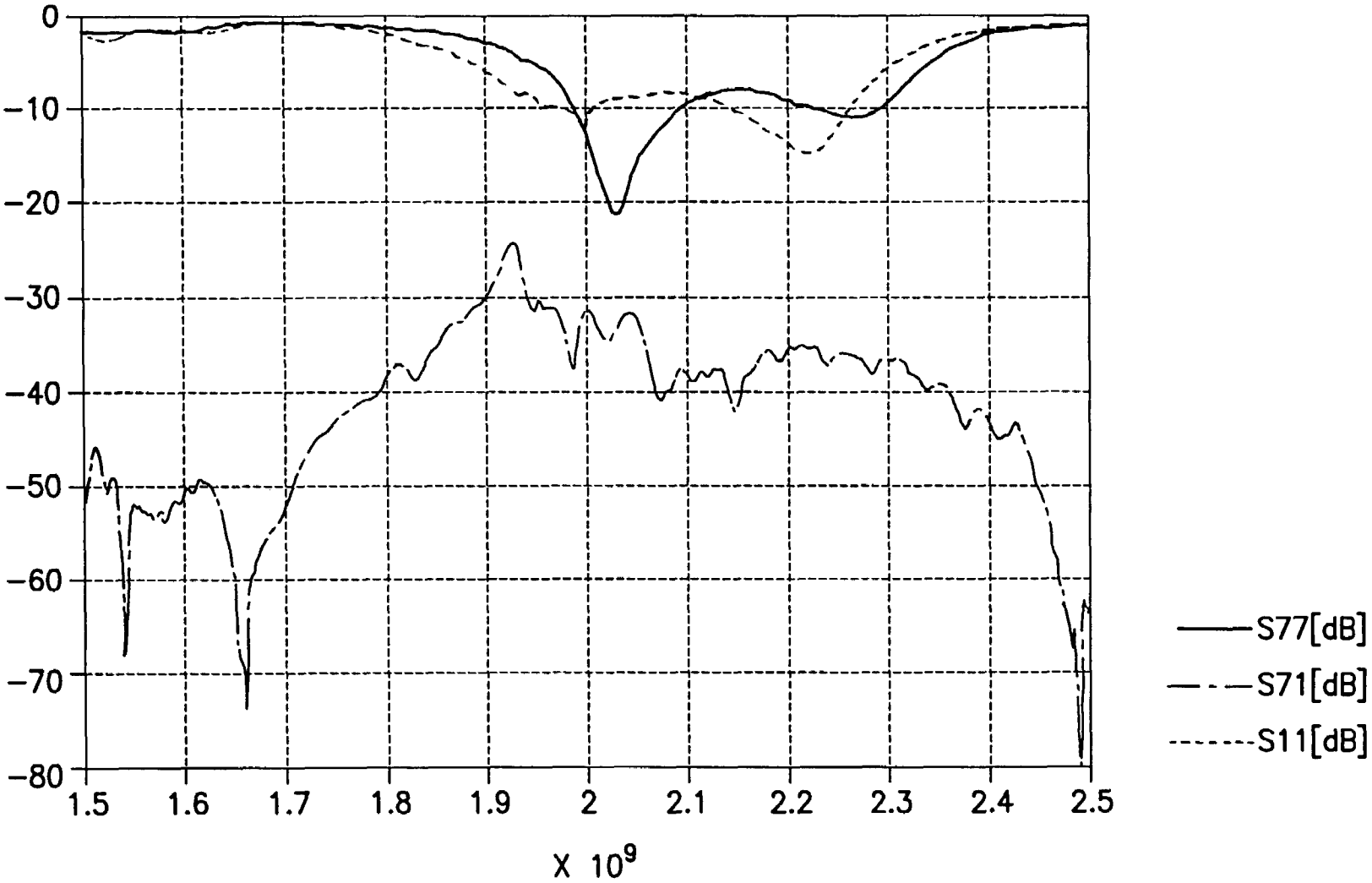
FIG. 6 is a diagram similar to FIG. 5, but showing mutual coupling between antenna unit cells with five periods of AML unit cells between them, according to an embodiment of the invention.

Embodiments of the invention described herein offer several distinct advantages. Specifically, wideband mutual coupling between distinct unit cells 22 or radiating elements 26 is reduced, for example in the 2 GHz range, by use of the AML unit cells 24 when the disposition of the antenna unit cells 22/radiating elements 26 relative to the AML unit cells 24 is optimized for that or any desired frequency range. FIG. 6 shows the measured mutual coupling between two radiating elements when using a continuous ground plane 32 that incorporates the AML unit cells 24, as shown in FIG. 1. The antenna separation is close to 0.7 $\lambda_0$ (free space wavelength) at 2 GHz.

While the known solutions used at microwave and millimeter wave frequencies to reduce mutual coupling without expanding spacing between antenna radiators use artificial high-impedance surfaces, embodiments of the invention disclosed herein employ AML unit cells 24 between adjacent ones of the antenna unit cells 22 to impede electromagnetic energy propagation along the ground plane 32 that would otherwise enable mutual coupling among adjacent radiating elements 26. In operation, a magnetic field is induced by the radiating elements 28 into the AML unit cell 24, which induces electrical currents in the metal components of the AML unit cell 24 and in the unitary ground plane 32. The geometry of the AML unit cell 24 is chosen so that all or substantially all of the magnetic field components induced in the AML unit cell 24 strongly interact with that AML unit cell(s) 24. In the known photonic bandgap (PBG) surface solutions, only the tangential fields can effectively excite the structure of those PBG structures.

Figure 2:
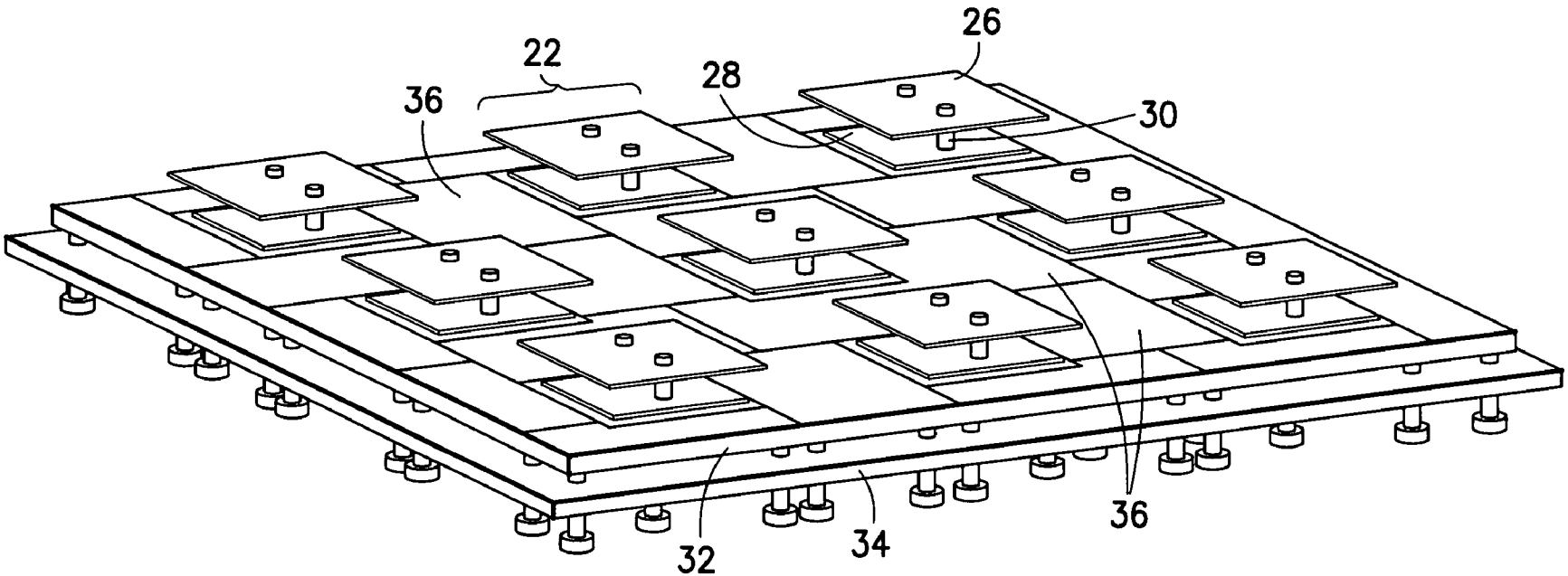
FIG. 2 is a schematic diagram of a test apparatus for configuring an antenna array according to one embodiment of the invention.

FIG. 2 is a schematic diagram of a test apparatus that may be used to optimize an antenna array in accordance with this invention, such as for the UMTS frequency range to use one non-limiting example. An antenna array 20 according to an embodiment of the invention is disposed similarly to the test apparatus of FIG. 2. As previously described, a plurality of antenna unit cells 22 (nine shown) are disposed in spaced relation across a continuous ground plane 32, where each antenna unit cell 22 includes a radiating element 26 and a ground plane element 28. The ground plane elements 28 may form part of the continuous ground plane, or may be disposed in electrical contact with a separate continuous ground plane 32. In the test apparatus, the various antenna unit cells 22 are mounted at their ground plane elements 28 to a rigid substrate 34, and a plurality of tiles 36 are similarly disposed between the antenna elements 22 with respect to the ground plane 32. Each tile 36 is made from a plurality of AML unit cells 24 arranged laterally so as to form an array of AML unit cells 24 lying between adjacent ones of the antenna unit cells 22. The tiles are mounted so as to be substantially co-planar with the ground plane elements 28, so that together the tiles 36 and the ground plane elements 28 of the various antenna unit cells 22 form the ground plane 32. In the test apparatus of FIG. 2, the tiles 36 are held in place by a magnetic coupling to the substrate. Magnetic coupling may also be used in the operational antenna array 20 in order to facilitate on-site fabrication of an array appropriate to a particular frequency band from component parts of tiles 36 and antenna unit cells 22. While electrically conductive tape was used to couple the ground plane elements 28 to the tiles 36 in the test apparatus, a specially fabricated conductive bridge may be employed in an operation antenna array 20 to make the electrical grounding connection. Close lateral spacing of the antenna unit cells 22, even within one half wavelength, is not prohibited by the use of embodiments of the invention, in order to enable a wideband antenna array within a compact physical space.

Figure 3:
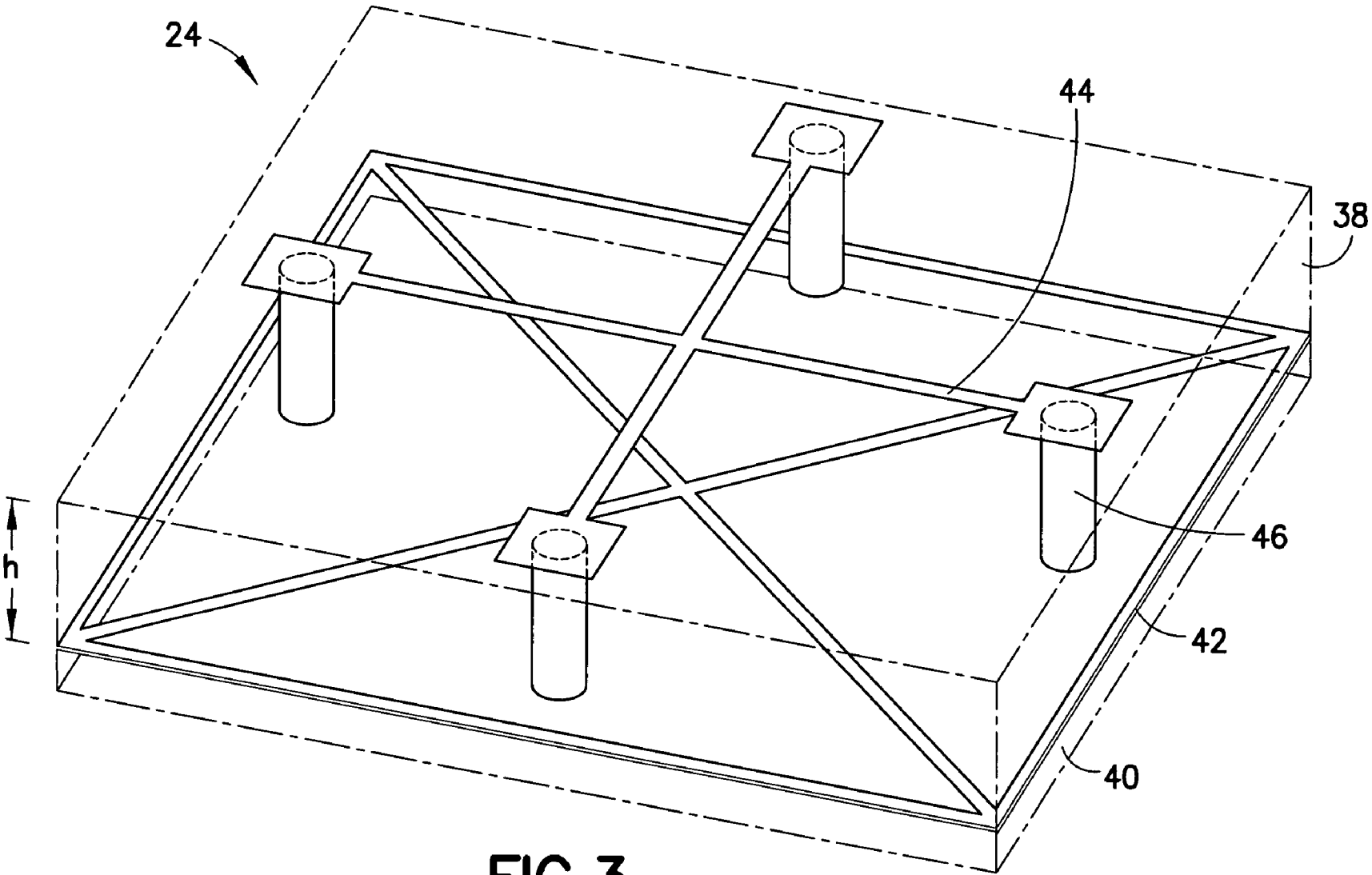
FIG. 3 is a schematic transparent view of an artificial magnetic layer unit cell disposed between antenna unit cells in the array of FIG. 2, according to an embodiment of the invention.

FIG. 3 illustrates construction of the AML unit cell 24 which forms the tiles 36. Note that the tiles 36 may be made entirely from rows and columns of AML unit cells 24, or may instead have spaces defined for accepting the AML unit cells 24 within conductive borders such as a frame that couple to the ground plane elements 28 of the individual antenna unit cells 22 (e.g., by the bridges noted above). The AML unit cell 24 is a multi-layer apparatus that functions as an artificial magnetic material, and includes a first dielectric layer, termed the ring dielectric 38, a second dielectric layer, termed the capacitor dielectric 40 disposed opposite one major surface of the ring dielectric layer 38, and a potentially a bonding layer 42 between them. Either or both dielectric layers 38, 40 may be made from any of the various metal oxides, Teflon or other dielectric materials known in the art. The choice of dielectric material for those layers 38, 40 will determine whether a bonding layer 42 is necessary or advantageous, and what type of material for that bonding layer 42. When disposed in the antenna array 20, the lower major surface of the capacitor dielectric layer 40 is in electrical contact with the ground plane of the antenna array 20, so when energy propagates along that ground plane a capacitance forms across the capacitor dielectric layer 40.

The ring dielectric layer 38 is configured to form pairs of split ring resonators (two split ring resonators shown in FIG. 3), where each resonator of a pair is orthogonal to the other of that pair. As shown in FIG. 3, four electrically conductive vias 46 penetrate the ring dielectric layer 38 and are coupled to one another through conductive strips 44 or traces disposed on a major surface of the ring dielectric layer 38 that lies opposite the capacitor dielectric layer 40. Each pair of vias 46 with its conductive strip forms a split ring resonator. Because the vias 46 are perpendicular to the ground plane of the overall array, the loop of the ring resonators lies perpendicular to the ground plane. A magnetic field associated with energy propagating along the ground plane induces a current in each split ring resonator, which is prevented from flowing due to the resonator ring being split (in the area adjacent to the bonding layer 42). That the rings are split greatly increases their resonance frequency. While linear conductive strips 44 are shown, other patterns may be used to form the split rings, such as for example a Jerusalem cross or gammadion shape. While pads are shown in FIG. 3 only along the conductive strips 44, conductive pads may also be disposed on the opposite 3ends of the conductive vias 46, especially advantageous where the vias 46 are coated with a conductive material rather than filled.

While FIG. 3 illustrates two split ring resonators, these teachings may be extended to four, six, or any number of pairs of split ring resonators by addition of further layers and vias. For example, four more conductive vias 46 may be disposed at corners of the structure of FIG. 3, and coupled by conductive strips 44 that lie on an insulating layer (not shown) disposed over the illustrated strips 46 so that the illustrated pair of rings and the additional pair of rings are not electrically coupled to one another. This technique may be extended for multiple ring pairs, and the insulating layer may or may not be of minimal thickness.

In effect, the structure 24 of FIG. 3 operates as an artificial magnetic layer because it becomes magnetic due to currents induced in the split ring resonators of the structure 24 by imposition of an external time-varying magnetic field. The electrical field induced in the conductive vias 46 of the rings lies in the vertical direction so the magnetic field lies in the horizontal, which results in substantially all components of the induced magnetic field strongly interacting with the ring dielectric layer 38 of the AML unit cell structure 24.

Engineering the dimensions of those rings and selecting the dielectric materials for the layers 38, 40 of the AML unit cell 24 enables one to engineer a desired magnetic response to an applied magnetic field, and that 'artificial' magnetic response can easily be made to be much larger than the magnetic field associated with natural magnets such as ferrous metals at low microwave frequencies (e.g. UMTS band). The range of magnetic response found in naturally magnetic materials is a small subset of that theoretically possible with artificial magnetic materials. For example, artificial electric response has been induced in metallic wire grids with spacing much smaller than the wavelength. Artificial magnetic materials, also known as metamaterials, may be engineered for magnetic fields well in excess of those found in naturally magnetic materials.

In the antenna arts, naturally magnetic materials lose their effective magnetic properties or become too lossy in the microwave regime. Desired magnetic properties are achieved in embodiments of this invention by engineering the AML unit cell 24 from non-magnetic constituents. By designing the AML unit cell 24 to generate a sufficient magnetic field from a desired radio frequency RF field (e.g., the UMTS band, about 1920-2170 MHz), the near field of one radiating element 26 may be re-distributed so as to avoid mutual coupling with lobes from nearby radiating elements 26. In nearly all cases, only the adjacent radiating element 26 is of concern for mutual coupling, as the increased spacing from non-adjacent radiating elements 26 mitigates coupling to a substantial degree. Because the magnetic field induced in the AML unit cell 24 for a given wavelength at the radiating element 26 is engineered for a much stronger magnetic field than is typically found in naturally magnetic materials, radiation efficiency of the antenna unit cell 22 is improved because the AML unit cells 24 reduce surface wave propagation along the ground plane 32, inhibiting mutual coupling among adjacent antenna unit cells 22 by a mechanism other than simple attenuation due to wavelength-dependent spacing.

An important aspect of the invention is that the AML unit cells 24 and the ground plane elements 28 form a coherent, unitary ground plane 32. The broader ground plane 32, and not only the ground plane element 28 of a particular antenna unit cell 22, operates in conduction with the operative radiating element 26 to launch RF energy. Were it otherwise and only the ground plane element 28 of an individual unit cell 22 operated in conjunction with the radiating element 26 to transmit RF waves, then there would be no mutual coupling due to surface waves among adjacent antenna unit cells 22 because the broader ground plane 32 would not propagate energy. But antenna arrays 20 are more effective with a common ground plane 32, whether or not the individual antenna unit cells 22 include their own ground plane element 28 that becomes a part of the common ground plane 32. Where a plurality of AML unit cells 24 are disposed between adjacent antenna unit cells 22, each AML unit cell 24 acts as a scatterer of RF energy from one radiating element 26 that would otherwise propagate and couple with other radiating elements 26.

In testing with the apparatus of FIG. 2, the inventors found that a period of at least five AML unit cells 24 as shown in FIG. 3 between antenna unit cells 22 resulted in mutual coupling between adjacent antenna unit cells 22 from −30 dB to −37 dB. In the tested array, the antenna unit cells 22 were arranged in three columns, each column containing three antenna unit cells 22, and five AML unit cells 24 were disposed between adjacent antenna unit cells 22 of adjacent columns. By disposing an array of AML unit cells 24 across a tile 36, various antenna arrays 20 may be made from off-the-shelf components or tiles 36 and antenna unit cells 22 for a particular frequency band without having to design specific AML unit cells 24 for a particular frequency, since excess AML unit cells 24 (beyond some point of diminishing return of coupling reduction) are mere surplusage and operate to further reduce mutual coupling between radiating elements 26 of the array.

Figure 4:
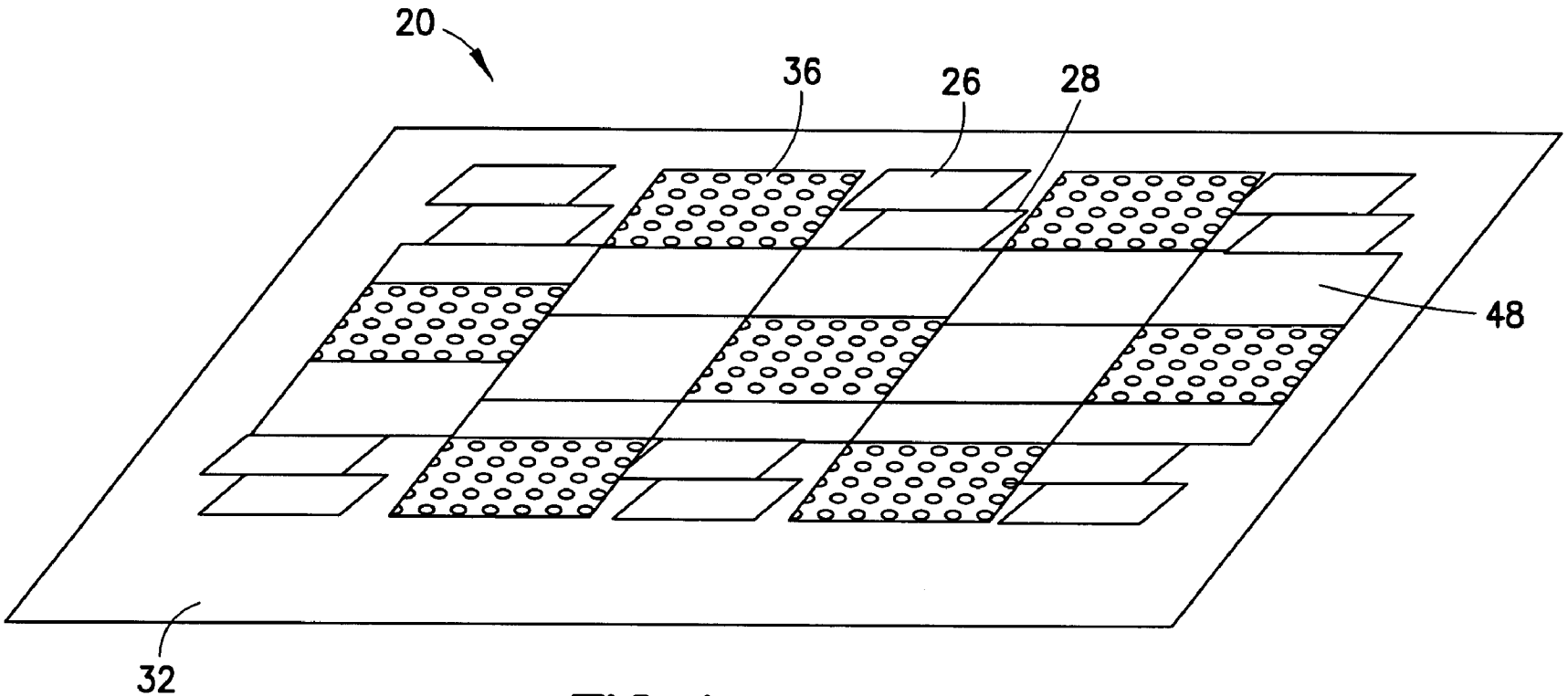
FIGS. 4 is a schematic diagram showing tiles of AML unit cells disposed along the ground plane between antenna unit cells in an antenna array, according to an embodiment of the invention.

FIG. 4 illustrates how such an antenna array 20 made from off-the-shelf components might be arranged. A substrate (not shown in FIG. 4) not unlike that shown in FIG. 2 may be employed to magnetically secure the components in place. Alternatively, screws, adhesives, or other more permanent bonding solutions may be employed to position the components relative to one another. Such a substrate operates as a structure on which the antenna array 20 is built, and need not be functional apart from retaining components in place relative to one another. A plurality of antenna unit cells 22 are deployed across the face of the substrate. Between each adjacent pair of antenna unit cells 22 is placed a tile 36 of AML unit cells 24, where each darkened circle on the tile 36 represents one AML unit cell 24. Preferably, the tile 36 includes at least five AML unit cells 24 in each row and at least five AML unit cells 24 in each column, so that disposing one tile 36 effectively reduces mutual coupling in the UMTS band to a level of below −30 dB. If the entire space between all antenna unit cells 22 is not filled with the tiles 36, additional ground plane filler plates 48 may be disposed to fill the gaps. Each of the tiles 36, ground plane filler plates 48, and grounding elements 28 of the antenna unit cells 22 lie in substantially the same plane and are electrically coupled to one another to form a contiguous and compact ground plane 32, with which any of the individual radiating elements 26 of the antenna unit cells 22 cooperate for transmissions and receptions of RF energy. As above, electrical coupling among these ground plane components may be via electrically conductive tape, or preferably by a conductive bridge that spans a lateral gap between adjacent tiles/plates/grounding elements and is made for that purpose.

Multiple unit cells as in FIG. 3 may be made from a single process with a constant thickness for the dielectric layer 38, then cut into individual AML unit cells 24 for mounting onto a tile 36 with other AML unit cells 24. In one embodiment, the thickness h of the AML unit cell 24 is about 2 mm. For the 2 GHz range, the capacitor dielectric layer 40 is about 0.5 mm, the ring dielectric layer 38 is about 1.6 mm, and the bonding layer 42 is about 0.04 mm for a total thickness of about 2.14 mm. (with some minimal additional thickness for the conductive strips 44 and any additional protective layer over them). From this baseline, the thickness h scales almost linearly with frequency, also accounting for the fact that the bonding layer 42 and thickness of the conductive strips 44 need not scale. For example, scaling the above dimensions for 1 GHz yields a capacitor dielectric layer 40 thickness of about 1.0 mm and a ring dielectric layer 38 thickness of about 3.2 mm, for a total thickness of about 4.24 mm. Similar extrapolation yields a total thickness of about 1.09 mm for the 4 GHz range. The lateral dimensions of the AML unit cell 24 may also be adjusted for different frequency bands (e.g., changing the span of the split ring resonators). For a center frequency about 2 GHz, the AML unit cell 24 measures about 9 mm square (specifically, 8.8 mm as tested).

Exemplary embodiments of this invention are seen as advantageously used in scanning antenna arrays that employ smart adaptive antennas. Smart adaptive antennas beamform with a feedback mechanism to adapt to the local RF environment. The tiles 36 of AML unit cells 24 can be inserted between the antenna unit cells 22 to form an antenna array 20 such as the one shown schematically in FIGS. 1 and 4. An advantageous antenna array 20 for the UMTS band (1920-2170 MHz) would include 32 antenna unit cells arranged in an 8×4 grid, with all lateral spaces between them filled with tiles 36 of AML unit cells 24, each tile bearing at least 5×5 AML unit cells where at least one tile 36 lies between each adjacent pair of antenna unit cells 22. The spacing between antenna unit cells 22 need not be limited to a minimum distance that depends from the intended wavelength, so the entire antenna array 20 may be smaller than would be fabricated under prior art techniques of physical spacing of at least one half wavelength. The antenna unit cells 22 may include a dual-polarized UMTS antenna element, and are particularly advantageous with dual slant-polarized antennas. Antenna polarization diversity is becoming more important for beamforming. Dual slant polarized antenna elements reduce the number of antennas required in a beamforming array, and typically exhibit symmetrical horizontal and vertical beam widths of 65-75 degrees.

Figure 5:
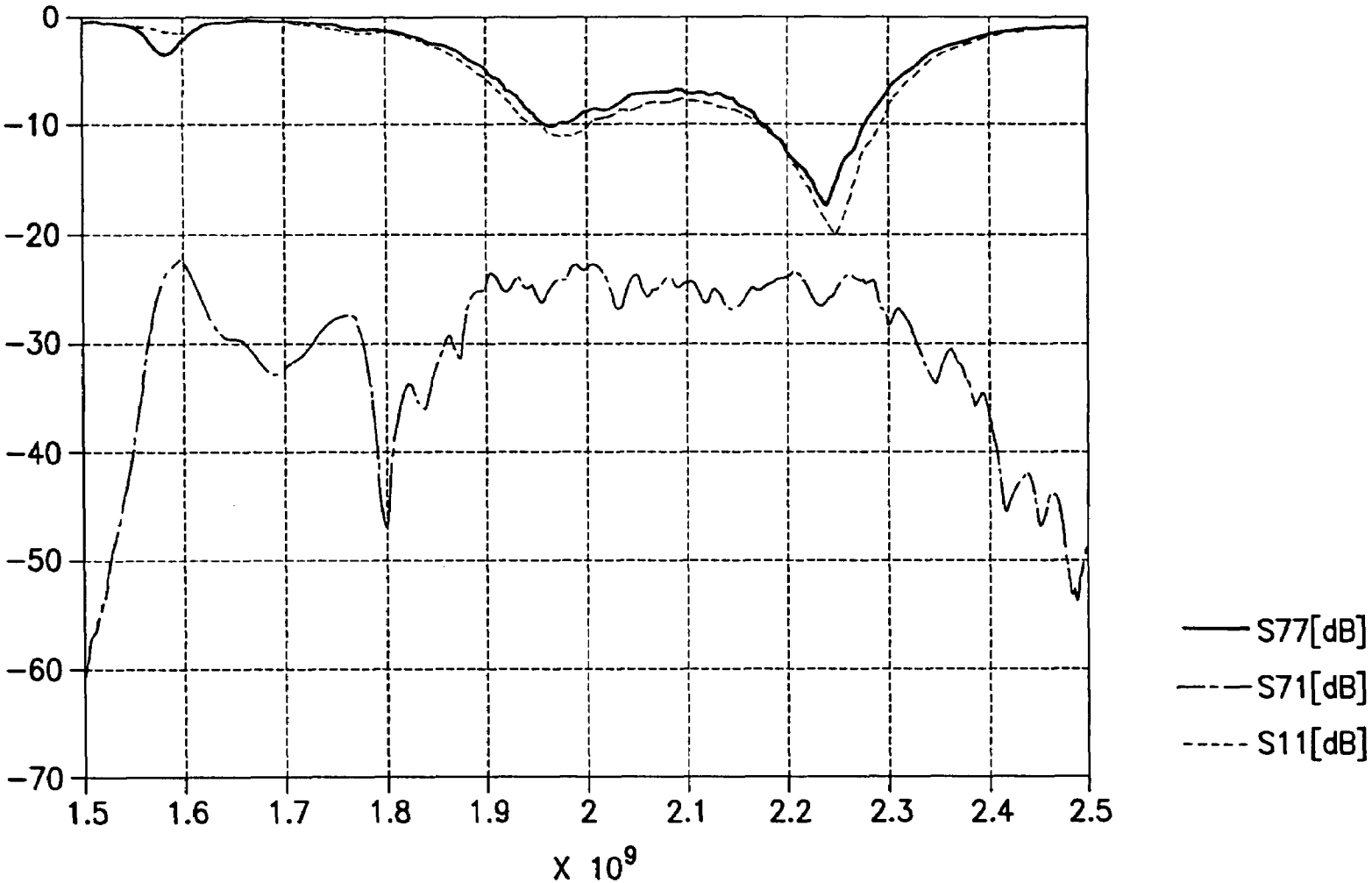
FIG.5 PRIOR ART
FIG. 5 is a prior art diagram of frequency (horizontal) versus signal level (dB) showing mutual coupling between antenna unit cells when PBG materials are used in the ground plane between antenna unit cells.

FIG. 5 is a graph showing the measured input matching of and mutual coupling between antenna unit cells 22 using an arrangement similar to that of FIGS. 2 and 4 but with a traditional ground plane common to all the antenna unit cells, with frequency along the horizontal axis and mutual coupling in dB along the vertical. The region near 2.0 GHz is of relevance for wireless telephony communications. The input matchings of the two test antenna ports, shown as S11 and S77 curves, are very similar. At about 2.0 GHz the mutual coupling for S71 is approximately −24 dB. Antenna spacing in the test was 0.7 $\lambda_0$ (where $\lambda_0$ is the free space wavelength). The measured mutual coupling result reflects the true performance level in most modern base station antenna arrays.

FIG. 6 is a graph similar to FIG. 5, but showing the input matchings and mutual coupling when a period of five AML unit cells 24 are disposed along the ground plane between the adjacent antenna unit cells 22. Note the vertical scale difference between FIGS. 5 and 6; the data of FIG. 6 shows the mutual coupling for S71 at −30 to −37 dB over the UMTS band of 1920-2170 MHz. Comparing FIGS. 5 and 6 reveals a fairly drastic reduction in mutual coupling by disposing AML unit cells 24 between the antenna unit cells 22, as compared to using a typical continuous ground plane.

Any antenna array 20 (e.g., a base station antenna) can be made smaller in size if AML tiles 36 are located between the array columns and/or rows. The reduced mutual coupling helps in retaining the antenna matching even if the elements 26 are physically closer to each other. Where the AML unit cell 24 is selected/engineered to have a permeability of more than unity as is preferred, each AML unit cell 24 may be smaller than the photonic bandgap unit cells of the prior art and thereby enable a smaller antenna array 20 than the prior art but with identical performance as to mutual coupling.

Although described in the context of particular embodiments, it will be apparent to those skilled in the art that a number of modifications and various changes to these teachings may occur. Thus, while the invention has been particularly shown and described with respect to one or more embodiments thereof, it will be understood by those skilled in the art that certain modifications or changes may be made therein without departing from the scope and spirit of the invention as set forth above, or from the scope of the ensuing claims.

What is claimed is:

1. An antenna array comprising:

a plurality of antenna unit cells disposed in an array and spaced from one another; each antenna unit cell comprising a radiating element and a ground plane element; and at least one artificial magnetic layer AML unit cell disposed between at least two adjacent ones of the antenna unit cells, said AML unit cell comprising at least one pair of split-ring resonators capacitively coupled to the ground plane elements of the adjacent antenna unit cells.

2. The antenna array of claim 1, wherein the AML unit cell comprises a capacitor dielectric layer coupled to a ring dielectric layer, and each of the split ring resonators comprise a pair of conductive vias penetrating the ring dielectric layer and coupled to one another by a conductive strip disposed along a surface of the ring dielectric layer opposite the capacitor dielectric layer.

3. The antenna array of claim 2, wherein each of the pair of split ring resonators are orthogonal to one another and orthogonal to the ground plane elements.

4. The antenna array of claim 2, wherein an array of AML unit cells are disposed between at least two of the adjacent antenna unit cells.

5. The antenna array of claim 4, wherein the array of AML unit cells are disposed in a tile that is removably coupled to the antenna array, and the array of AML unit cells comprises at least five AML unit cells.

6. The antenna array of claim 4, wherein an array of AML unit cells is disposed between each adjacent pair of the plurality of antenna unit cells.

7. The antenna array of claim 1, wherein the AML unit cell is substantially co-planar with the ground plane elements of the adjacent antenna unit cells.

8. An apparatus comprising:

an array of unit cells disposed on a common substrate, each unit cell comprising:

a first layer of dielectric material defining a first and an opposed second major surface;

a second dielectric layer disposed adjacent to the first major surface;

a pair of intersecting conductive traces disposed on the opposed major surface of the first layer of dielectric material; and at least four conductive vias penetrating the first layer of dielectric material but not the second layer of dielectric material, each of said conductive vias spaced from one another and coupled to a conductive trace.

9. The apparatus of claim 8, wherein the array comprises at least five of the unit cells disposed along a line.

10. The apparatus of claim 9, wherein the four conductive vias and the pair of conductive traces are disposed so as to form a pair of split ring resonators that are orthogonal to one another.

11. The apparatus of claim 9, wherein the pair of conductive traces comprises a first pair, and the four conductive vias comprise a first set of vias, the apparatus further comprising:

an insulating layer disposed over the first pair of conductive traces;

a second pair of conductive traces disposed over the insulating layer opposite the first pair of conductive traces; and a second set of at least four conductive vias penetrating the first layer of dielectric material and the insulating layer but not the second layer of dielectric material, each of said conductive vias of the second set spaced from one another and coupled to a conductive trace of the second pair.

12. The apparatus of claim 9, wherein the ring dielectric layer defines a thickness about 1.6 mm and the capacitor dielectric layer defines a thickness about 0.5 mm.

13. A method of making an antenna array comprising:

providing a substrate particularly adapted to retain components in spaced relation to one another;

securing to the substrate a plurality of antenna unit cells, each antenna unit cell spaced from each other antenna unit cell and each antenna unit cell comprising a ground plane element spaced from a radiating element;

securing to the substrate, between each pair of adjacent antenna unit cells, a tile comprising an array of artificial magnetic layer AML unit cells, each AML unit cell comprising a ring dielectric layer having a first and a second surface, a capacitor dielectric layer coupled to the first surface, a pair of conductive traces disposed adjacent to the second surface, and a set of at least four conductive vias penetrating the ring dielectric layer but not the capacitor dielectric layer, each of said conductive vias spaced from one another and coupled to the pair of conductive traces; and capacitively coupling the AML unit cell to at least one of the ground plane elements.

14. The method of claim 13, wherein each tile comprises at least five AML unit cells disposed in a line between adjacent antenna unit cells.

15. The method of claim 13, wherein the tiles and the ground plane elements lie substantially in a same plane.

16. The method of claim 13, wherein the pair of conductive traces and the set of at least four conductive vias form two split ring resonators that are orthogonal to one another.

17. An arrayed apparatus comprising:

a plurality of means for wirelessly communicating RF energy over a frequency, said means for wirelessly communicating arrayed in spaced relation to one another;

a plurality of means for inhibiting mutual coupling, each means for inhibiting mutual coupling disposed between adjacent ones of the plurality of means for wirelessly communicating RF energy, each of said means for inhibiting mutual coupling comprising at least one split ring resonator; and conductive means for electrically coupling each of the plurality of means for inhibiting mutual coupling to one another; wherein the conductive means and each said means for inhibiting mutual coupling are disposed in a common ground plane.

18. The arrayed apparatus of claim 17, wherein:

the means for wirelessly communicating RF energy over a frequency comprises a radiating element of an antenna unit cell; and the means for inhibiting mutual coupling comprises at least one AML unit cell, the AML unit cell comprising a ring dielectric layer coupled on one side to a capacitor dielectric layer and having disposed on an opposed side a conductive trace that is coupled to the capacitor dielectric layer by a set of conductive vias that penetrate the ring dielectric layer.

19. The arrayed apparatus of claim 17, wherein the conductive trace and the set of conductive vias form a first split ring resonator, the apparatus further comprising another split ring resonator disposed orthogonal to the first split ring resonator and both the first and second split ring resonators lie substantially perpendicular to the common ground plane.

* * * * *